US005636461A

United States Patent [19]

Shewmaker

[11] Patent Number: 5,636,461

[45] Date of Patent: Jun. 10, 1997

[54] VISUAL AID DEVICE FOR STRETCHING, ALIGNING, AND MOUNTING NEEDLEPOINT FABRIC

[76] Inventor: Lisa M. Shewmaker, 16222 Beaumont Hwy., Houston, Tex. 77049

[21] Appl. No.: 661,165

[22] Filed: Jun. 10, 1996

[51] Int. Cl.[6] ..... D06C 3/08

[52] U.S. Cl. ..... 38/102.1; 33/1 K

[58] Field of Search ..... 38/102, 102.3, 38/102.1, 102.5; 139/1 R; 33/1 B, 1 C, 1 F, 1 G, 1 K

[56] References Cited

U.S. PATENT DOCUMENTS

| | | | |
|---|---|---|---|
| 3,786,586 | 1/1974 | Schulte et al. | 33/76 R |
| 3,939,564 | 2/1976 | Slawinski | 33/1 K |
| 4,058,215 | 11/1977 | Marchbank | 38/102.1 |
| 4,317,301 | 3/1982 | Timphony et al. | 38/102 |
| 5,024,176 | 6/1991 | Musante | 112/266.1 |
| 5,113,140 | 5/1992 | Fray | 38/102.91 |
| 5,255,455 | 10/1993 | Hopper | 38/102.1 |
| 5,357,699 | 10/1994 | Padawer | 38/102 |

FOREIGN PATENT DOCUMENTS

| | | | |
|---|---|---|---|
| 1105333 | 7/1984 | U.S.S.R. | 33/1 K |

*Primary Examiner*—Andy Falik

[57] ABSTRACT

A device for stretching, aligning, and mounting fabric with a visible weave pattern, particularly needlepoint fabric, to a substrate prior to framing. This is done in such a way as to render the weave accurately square. This device or apparatus is comprised of a flat, square shaped, rigid sheet of material upon which the work to be stretched is placed. Along the perimeters of this rigid base is a wood fillet wrapped with a hook and loop fastening material upon which tabs made of reciprocating hook and loop fastening material are placed. Elastic cords extend across and over the needlepoint fabric to be stretched and are secured at each end by these tabs which are selectively placed along the wrapped wood fillet so as to produce a squared elastic grid. The accuracy of the square grid is made possible by the placement of a measurement system along the perimeters of the rigid base just inside the wrapped wood fillet. Since the encased wood fillet gives the elastic enough clearance above the needlepoint to be stretched, the visual guide provided by the elastic remains unmoved while the needlepoint underneath is pulled and stretched into alignment with them. The needlepoint fabric is secured to the substrate at this point and is ready for framing.

1 Claim, 4 Drawing Sheets

VISUAL AID DEVICE FOR STRETCHING, ALIGNING, AND MOUNTING NEEDLEPOINT FABRIC

BACKGROUND OF THE INVENTION

1. Field of the Invention

The present invention is related to the field of device for stretching, aligning, and mounting fabric, particularly needlepoint on a suitable substrate prior to framing.

2. Description of Prior Art

Needlework and fabric art are often mounted on a mounting board and framed for display. This is generally accomplished by stretching the fabric over the board and securing it by lacing the fabric over the mounting board with needle and thread, stapling or pinning the fabric to the board, gluing the fabric to the mounting board with various types of glue, or adhering the fabric with double sided tape around the perimeter of the mounting board.

One approach known to exist but not uncovered by a patent search addresses the problem of squaring the weave of needlepoint fabric by a process called "blocking". By this method, a textile is dampened and placed on a masonite board having evenly spaced holes. Rustproof aluminum nails are used to pierce through the perimeter of the fabric and lodge in the holes of the masonite, starting at one corner of the fabric piece and working all the way around until the piece is stretched evenly and square. When it is dry, the piece should retain its shape. The negative point of this approach is that many fabrics have too delicate a weave to have nails pass through them without damage. Another negative point is that the task of transferring the blocked item to a mounting substrate and centering it before securing it is still required. Not only is that a consideration, but the fabric weave will show a scalloped configuration at each point where the nails held the fabric. This weave alignment problem must also be dealt with when stretching.

The key to stretching needlepoint is to stretch the weave of the cloth perfectly straight and square and at the same time center the image. This requires a certain degree of skill and a considerable amount of time on the part of the person doing the mounting simply because accurate alignment and centering of the needlepoint image on the mounting board is so very difficult. This difficulty was reduced by an invention by Joseph M. Frey, U.S. Pat. No. 5,133,140 (1992). His approach involved a small channel molding with a plurality of barbs or teeth that is affixed to the outside perimeter of a mounting substrate. The needlepoint textile is then stretched over the board and impaled on the teeth, repositioned countless times if needed, then secured. Although this invention took the fear out of trial and error, and one can stretch with the confidence that repeated attempts to center the image and align the weave won't damage the textile, it did not amply abbreviate the time it takes to get it right. Another point to consider when using his invention is that it does not address the circumstance in which there is not enough textile left around an image to wrap around the sides of a mounting substrate. In this instance, the edges of the board can no longer physically guide the person doing the mounting and he is left with no system of centering or alignment.

SUMMARY OF THE INVENTION

This problem is specifically addressed by the present device. It offers two very important solutions to stretching needlepoint fabric. First the physical attributes of the device itself creates an alignment system allowing the needlepoint to be quickly and confidently stretched into a 90° square shape without the visual help of the board edges. Secondly, the method employed in conjunction with the device allows the freedom to center the needlepoint the first time as near to perfection as a person is individually capable of. Now, this device was designed to anticipate and solve the situation created by the customer's decision to have their piece matted, whether or not the construction of their textile demanded a matting solution or simply an option to mat the piece. In explanation, a mat is a solid piece of 4-ply paperboard available in the framing industry in a large variety of decorative colors. The center is cut out leaving an opening through which the needlepoint image is visible, but its fabric selvages are not.

A situation that would make it mandatory to use a mat is in the event that the needlepoint fabric is smaller than the size mounting substrate selected to go in a picture frame. Now the needlepoint must be affixed to the face of the mounting substrate. Since the edges of the mounting substrate cannot be used to square the needlepoint, the visual guide supplied by this present device provides a system of alignment that is suspended directly above the needlepoint without touching it. In this way, the needlepoint fabric can be moved, stretched, and secured without disturbing the guide. This invention stretches elastic cords over the textile without touching it, and after adjusting the elastic cords to lay square, the textile is stretched so that the weave of the fabric is lined up visually alongside the elastic cords, which results in a square stretch job. Then, the mat that is placed over it will demonstrate that each row of the fabric weave lies very straight against the inside mat edge all the way around. This device and method takes the guesswork out of squaring and mounting needlepoint and converts an agonizingly long trial and error period into a one time success involving only minutes.

DESCRIPTION OF THE PREFERRED EMBODIMENT

Figure 1:
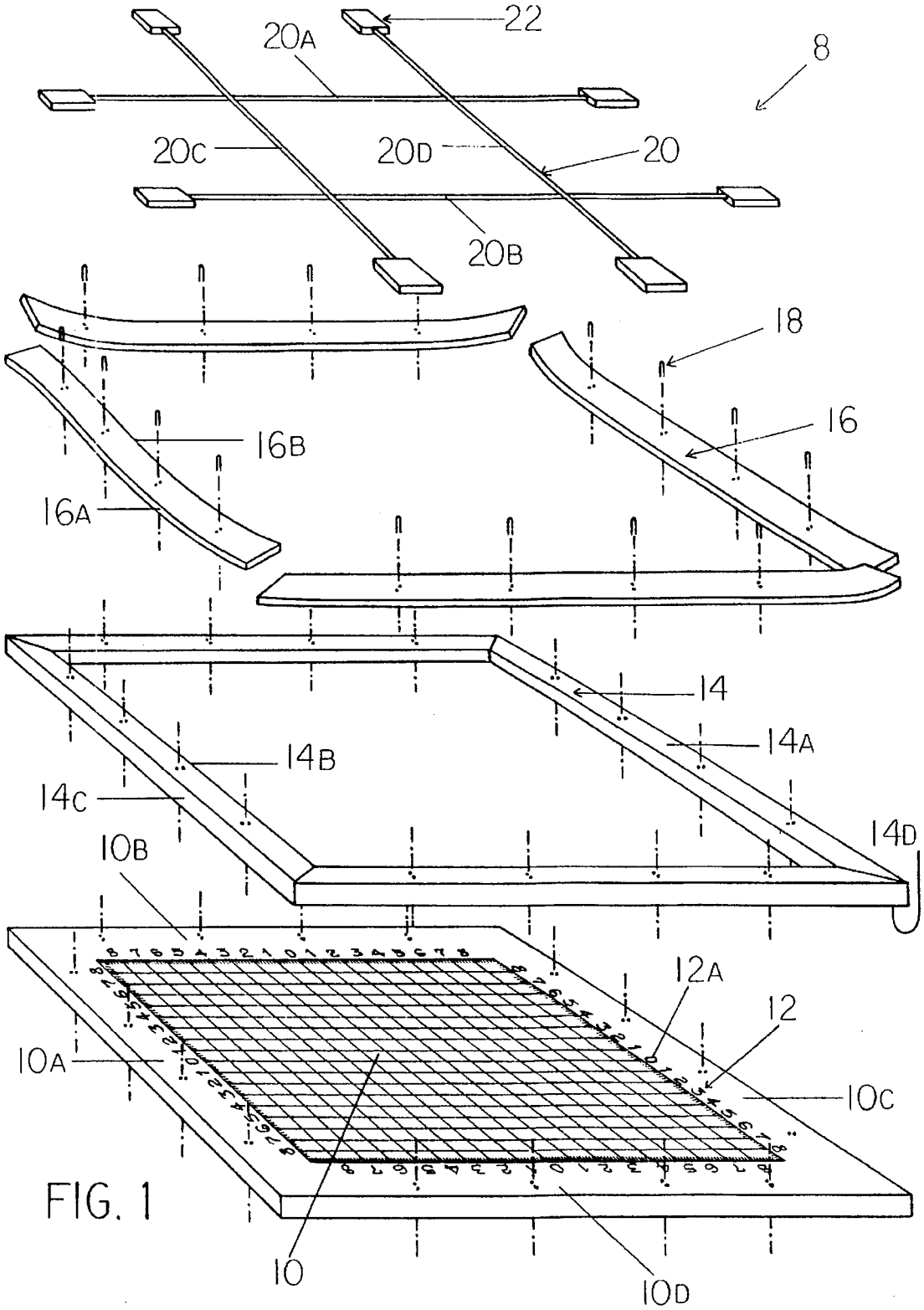
FIG. 1 is an exploded perspective view of all component parts and method of their assembly.

Referring now to the drawings, and in particular to FIG. 1, there is shown the preferred embodiment of apparatus 8 in an exploded view showing the order of assembly. A rigid, flat base 10 is a single one piece unit derived from material that provides rigidity and a smooth surface. The thickness of the base 10 should be such that the rigid properties are not compromised as it is the support for all following components. Upon the surface of the base is affixed a centering measurement system 12 which extends around the complete perimeter of the base 10 whereby a digit "0" 12*a* is located at the exact center toward the outside perimeter of base 10. All numerical digits progress in sequence from that centerpoint on either side of the digit "0" 12*a* in increments standard to needlepoint rows and columns 12*b* toward an outside edge of base 10, a side 10*a*, for example. Then this process would be repeated on a side 10*b*, a side 10*c*, and a side 10*d*. This measurement system 12 should be affixed with regard to a proper distance or margin from the outside edges of sides 10*a*, 10*b*, 10*c*, and 10*d* so that the measurement system 12 is still visible after a wood fillet 14 is secured to the base 10. This wood fillet 14 is encased by the loop side of a hook and loop fastening material 16 and mitered at a 45° angle before securing to base 10 by using construction staples 18 as this drawing depicts. The remaining components of this apparatus 8 include a set of four elastic cords 20 bound at each end by a tab 22 consisting of the hook side of a hook and loop fastening material 16. The length of these elastic cords 20 should be sufficient to stretch an elastic cord 20*a* and an elastic cord 20*b* from base side 10*a* to base side 10*c*, and an elastic cord 20*c* and an elastic cord 20*d* from base side 10*b* to base side 10*d*. There should be enough elastic tension to hold the elastic cords 20 reasonably taut with no great resistance when each tab 22 is placed on the wood fillet 14 encased by the hook and loop fastening material 16. The combination of the wood fillet 14 encased by the hook and loop fastening material 16 can hereafter be described as an encased wood fillet 15 when deemed necessary.

Figure 2:
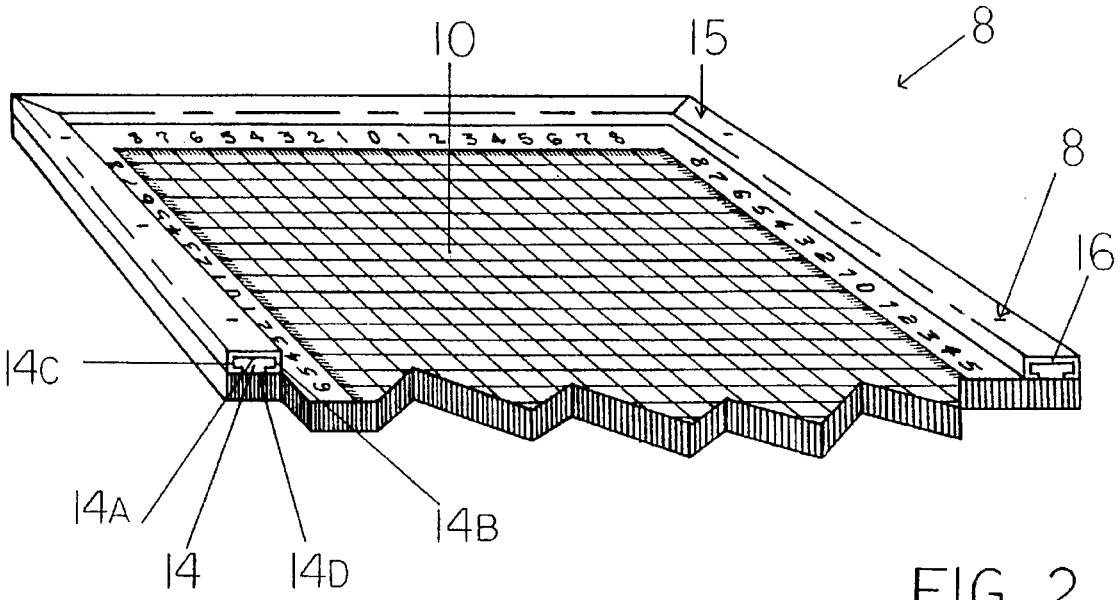
FIG. 2 is a perspective cross sectional view indicating the manner in which a hook and loop fastening material is applied and secured to a wood fillet.

The manner in which the wood fillet 14 is covered by the hook and loop fastening material 16 is depicted in FIG. 2. Rather than gluing the hook and loop fastening material 16 to the top of the wood fillet 14 where repeated repositioning of any of the tabs 22 might deteriorate the adhesion, the method of choice is to wrap the hook and loop fastening material 16 around the circumference of the wood fillet 14 until a wood fillet topside 14*a*, a wood fillet side 14*b*, and a wood fillet side 14*c* were completely encased. A remaining hook and loop fastening material side selvage 16*a* and a hook and loop fastening material side selvage 16*b* of FIG. 1 almost meet on a wood fillet bottomside 14*d* as depicted in FIG. 2. As stated before, construction staples 18 are depicted here as the means of securing the encased wood fillet 15 to the base 10.

Figure 3A:
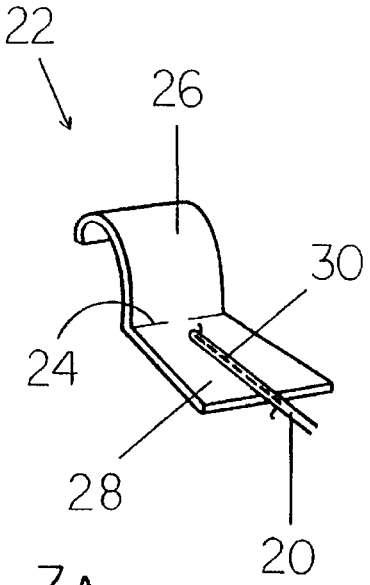
FIG. 3*a* is an enlarged perspective view of the first step involved in securing an elastic cord to a tab consisting of a hook and loop fastening material.
Figure 3B:
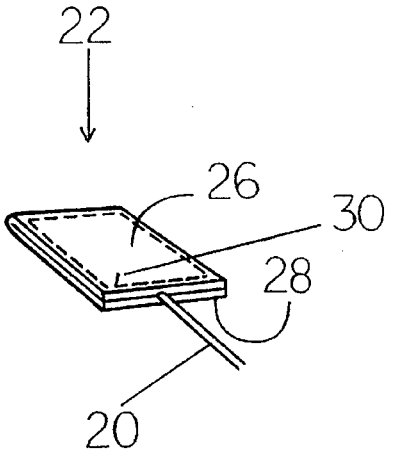
FIG. 3*b* is an enlarged perspective view of the second and final step involved in securing an elastic cord to a tab consisting of hook and loop fastening material.

The manner in which the elastic cords 20 are bound by the tabs 22 can be illustrated by the method shown in FIGS. 3*a* and 3*b*. In FIG. 3*a*, the tab 22 in its unconstructed state has been folded in half with the non hook and loop surfaces touching as to cause a visible crease 24 when opened back up. The crease 24 becomes the point at which a tab half 26 and a tab half 28 are discernible. The elastic cord 20 is then placed on the non hook and loop surface of tab half 28 whereby the length of the elastic cord 20 lies in the center of the tab half 28, perpendicular to the crease 24, and the end of the elastic cord 20 stops short of the crease 24. This elastic cord can now be secured by a machine stitch line 30 by a conventional sewing machine. The final step in the construction of this tab is shown in FIG. 3*b* whereby tab half 26 is folded down onto tab half 28 and secured by a machine stitch line 30 together at all perimeters.

Figure 4:
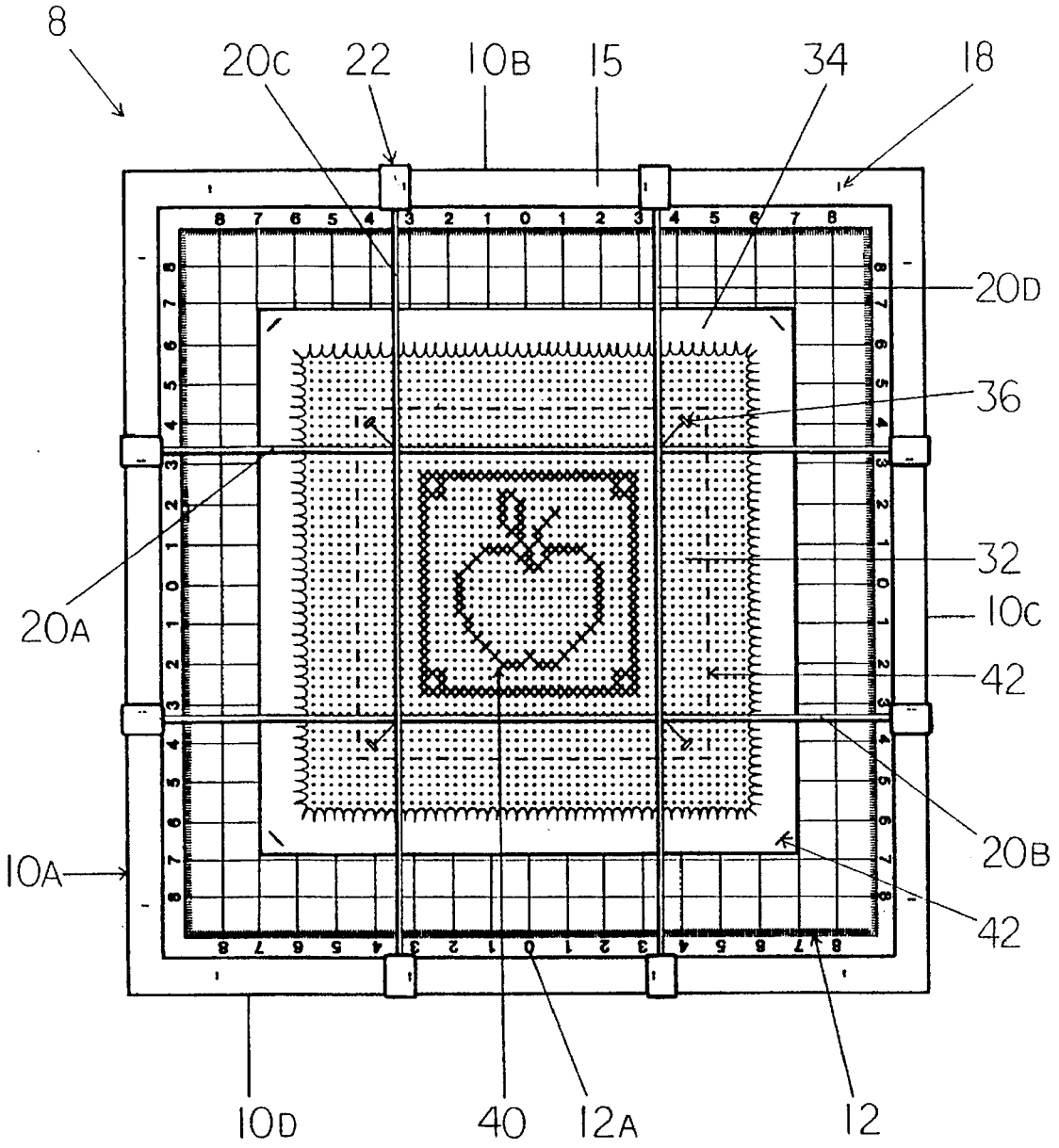
FIG. 4 is a plan view illustrating the method of operation using an example of needlepoint art and its substrate.

The operation of this apparatus 8 is illustrated by FIG. 4. A suitable substrate 34 upon which a needlepoint fabric 32 will be affixed is laid upon the surface of the base 10 without regard to centering. The needlepoint fabric 32 is laid on the surface of the substrate 34. The substrate 34 is cut at least an inch bigger all the way around so that exact centering of the needlepoint fabric 32 on the substrate 34 does not become an issue at this time. The substrate 34 must now be immobilized by either taping or stapling it to the base 10 to prevent it from moving while the needlepoint fabric 32 is being stretched. The elastic cords 20 are stretched across the base 10 in the following manner: Elastic cords 20*a* and 20*b* stretch from base side 10*a* to base side 10*c*, and elastic cords 20*c* and 20*d* stretch from base side 10*b* to base side 10*d*, the tabs 22 of which are secured by the interaction of the hook and loop fastening material of the tabs 22 and the encased wood fillet 15. The arrangement of the elastic cords 20 at right angles to each other creates a square grid. The measurement system 12 provides the means of positioning the elastic cords to form a grid that is accurately square by positioning the tabs 22 on the encased wood fillet 15 so that the elastic cords 20 are suspended visually over the marked increments of standard needlepoint row and columns 12*b* of the measurement system on one side of the base 10 and the same position is duplicated on the opposite side of the base 10. The reason for the presence of the wood fillet 14 becomes apparent now as its thickness provides the clearance necessary so that the elastic cords 20 are suspended over the needlepoint fabric 32 and its substrate 34 without touching them so that the needlepoint fabric 32 can be pulled and tugged into alignment without disturbing the visual guide that the elastic cords 20 provide.

The next step is to insert a quilting pin 36 through the weave of the needlepoint fabric 32 into the substrate 34, one in each corner where elastic crosses elastic, one at a time following one row of the weave of the needlepoint fabric 32 all the way around, stretching the needlepoint fabric 32 gently at each corner before securing with the pins 36. One method of affixing the needlepoint fabric 32 to its substrate 34 is by using a series of staples 42 of a thickness best suited to piercing textile. According to this method one would start at one corner where elastic crosses elastic, and gently pull the needlepoint fabric 32 until its rows are lined up visually with the elastic cords 20 stretched over it, securing it with staples 42 throughout this alignment process.

Figure 5:
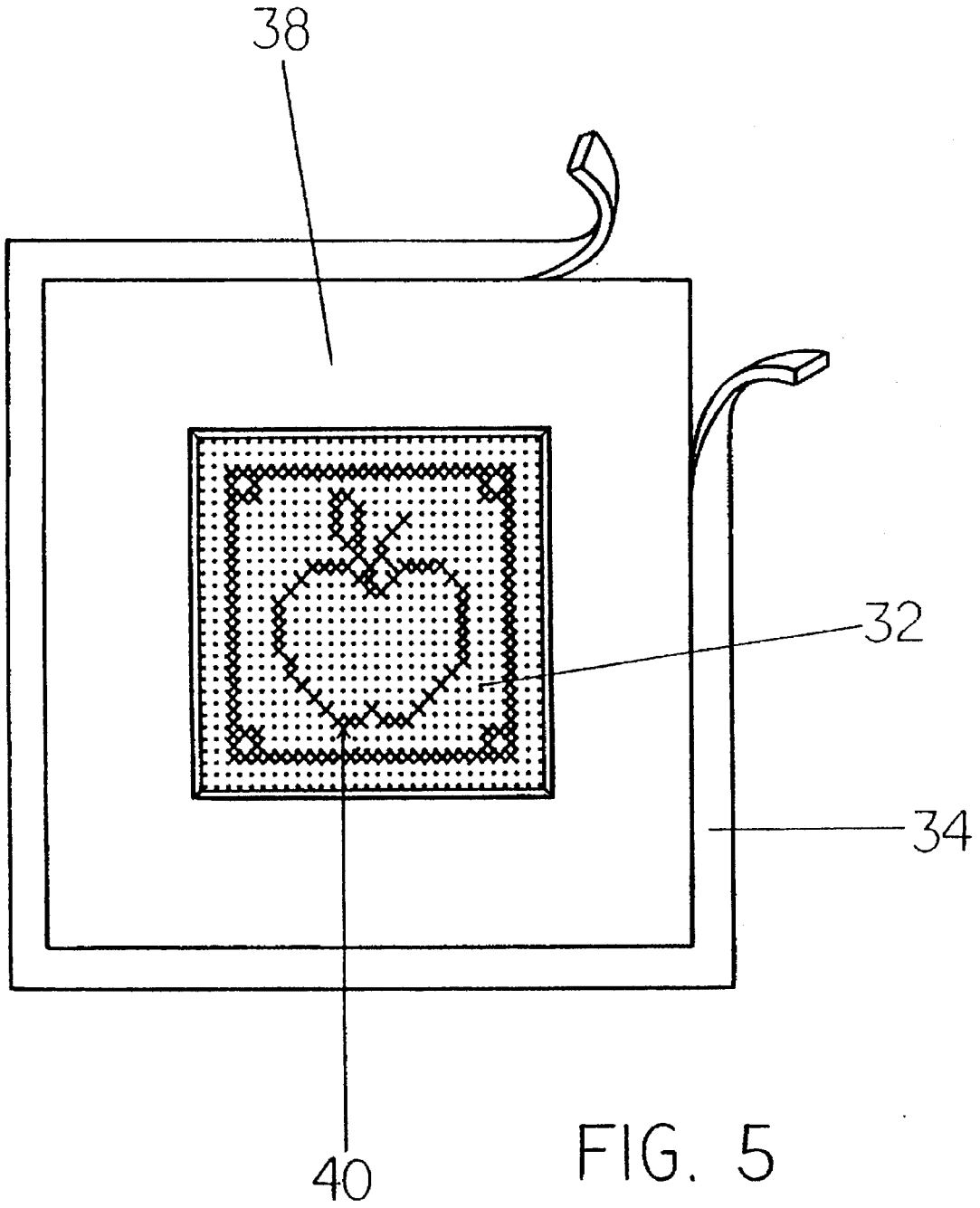
FIG. 5 is a plan view of the needlepoint art and substrate after removal from the device illustrating the final steps involved before framing.

At this point, the apparatus has fulfilled its purpose and the work piece may be removed. A lay person with no framing skills or equipment would then take this piece to a frame shop to be matted and framed, knowing that in many cases, a stiff stretch labor fee was saved by doing it themselves. However, in the hands of a frame shop, the method for centering the stretched needlepoint fabric 32 before matting and framing is as easy as cutting a proper size mat 38 with the proper size opening and placing it over the needlepoint fabric 32 as shown in FIG. 5. The mat 38 is moved up, down, and from side to side until the optimum visual balance is obtained concerning a needlepoint image 40. A line is scored around the boundaries of the mat 38 on the surface of the substrate 34. The mat is removed just long enough for the framer to cut away the excess of the substrate 34 and the mat is replaced and the finished piece is framed.

While specific embodiments of the invention have been illustrated and described herein, it is realized that modifications and changes will occur to those skilled in the art. It is therefore to be understood that the appended claim is intended to cover all such modifications and changes as fall within the true spirit and scope of the invention.

I claim:

1. A visual aid device for accurately positioning a woven fabric having a needlepoint design on a support in a squared and centered alignment comprising:

a rigid support base onto which the fabric is attached;

said base including a measuring system thereon in increments of needlepoint rows and columns onto which said design is defined adjacent its perimeter;

a frame positioned on top of said base and outside of the measuring system, wherein the outside edges of the frame are located adjacent with the outside edges of said base allowing for the needlepoint design to be located within the inside edges of said frame;

a fastening means attached to the top surfaces of said frame;

a plurality of linear elastic alignment guides including removable fastening means at their ends for their attachment to said frame fastening means, wherein said guides are in a loosened unattached state for insertion of fabric onto the base portion within said inside frame edges and in a stretched state on said frame when extended across and over said fabric;

whereby said linear guides are suspended over the edges of the fabric with their ends located at selected needlepoint row or column increments on said measuring system to form a squared grid to allow for the fabric on said base to be pulled and tugged without disturbing said guides to the position of said squared and centered fabric alignment.

* * * * *